United States Patent [19]

Bratchell

[11] Patent Number: 4,717,114

[45] Date of Patent: Jan. 5, 1988

[54] CONCRETE SLEEPER MOULD

[75] Inventor: Robert L. Bratchell, Brighton, Australia

[73] Assignee: Monier Limited, Brighton, Australia

[21] Appl. No.: 883,070

[22] Filed: Jul. 8, 1986

[30] Foreign Application Priority Data

Jul. 10, 1985 [AU] Australia ..... PH01409

[51] Int. Cl.[4] ..... B28B 7/26; B28B 23/00

[52] U.S. Cl. ..... 249/86; 249/94; 249/119; 264/297.9

[58] Field of Search ..... 249/86, 91, 93, 94, 249/119, 205; 425/111; 264/228, 297.9; 238/84, 115

[56] References Cited

U.S. PATENT DOCUMENTS

| | | | |
|---|---|---|---|
| 3,471,118 | 10/1969 | Bormann et al. | 249/86 |
| 4,038,355 | 7/1977 | Bratchell | 249/86 |
| 4,102,957 | 7/1978 | Da Re | 249/86 |
| 4,204,660 | 5/1980 | Feuillade | 249/86 |
| 4,522,367 | 6/1985 | Thim | 264/297.9 |

*Primary Examiner*—Jay H. Woo
*Assistant Examiner*—James C. Housel

[57] ABSTRACT

In a bank of sleeper moulds wherein the moulds lie side by side and contain shoulder receiving apertures which locate shoulders during pouring, the improvements including a rocker shaft journalled for rotation with respect to the moulds and having retaining members thereon which retain the shoulders and urge them into engagement with locating means.

7 Claims, 6 Drawing Figures

CONCRETE SLEEPER MOULD

This invention relates to a bank of sleeper moulds for the moulding of a concrete sleeper in an in-line moulding installation.

BACKGROUND OF THE INVENTION

In an in-line moulding installation, shoulders are positioned through apertures in the bases of the moulds so that the shoulder stems project upwardly and the portions of the shoulders, which will, in use, accept the rail retaining clips, depend from the moulds (the sleepers being moulded upside down), reinforcing wires are run along the length of the line of moulds and are tensioned, the concrete is poured to embody the upstanding shoulder stems, the concrete is allowed to at least partly cure and spacers between adjacent sets of moulds are withdrawn, and after sufficient additional curing has taken place, the reinforcing wires are severed between the sleepers of adjacent moulds. The moulds are then inverted, and the completed sleepers discharged onto a fork-lift truck or other handling means.

One difficulty which is encountered with certain types of shoulders is that they must be accurately located, and to this end the apertures in the mould bases must be a close enough fit for the shoulders that there is little movement. If the clearance space between the shoulder edges and the walls defining the apertures is too small, removal of the moulded sleepers from the moulds is rendered difficult, while if they are too large, there is a flow-through of slurry from the concrete mix and this will deposit upon locating means and retention means carried beneath the sleeper moulds, and if this occurs a great deal of time needs to be spent in maintenance and cleaning between pours of concrete in the installation.

This invention is particularly directed to use with a concrete sleeper shoulder of the type having a stem to be embodied within the concrete, and an upwardly directed recess defined by a front (datum) wall and side wings, and wherein the side wings contain wing side recesses which face one another. Such shoulders are known in the art and will accept plate-like clips.

BRIEF SUMMARY OF THE INVENTION

An object of this invention is to provide improvements whereby the build-up of slurry beneath moulds on locating bars or fingers is substantially reduced. Another object of this invention is to provide improvements which allow a more accurate positioning of the shoulder in the aperture provided in the mould. Briefly, according to this invention therefore, there are provided improvements in a bank of sleeper moulds wherein the moulds lie side by side and contain shoulder receiving apertures which locate shoulders during pouring, the improvements including a rocker shaft journalled for rotation with respect to the moulds and having retaining members thereon which retain the shoulders and urge them into engagement with locating means.

More specifically, in an embodiment of this invention, the improvements comprise a rocker shaft for rotation about its longitudinal axis, a plurality of retaining members carried on the rocker shaft, the shape, size and location of each said retaining member being such that it releasably retains a shoulder when engaged thereby, and locating means also located below the moulds and so positioned as to locate the shoulders with respect to the moulds when the retaining members urge the shoulders into engagement with the locating means.

One of the difficulties which is encountered in the moulding of concrete sleepers is that although steel and concrete normally have about the same coefficient of expansion, when the mould is heated for curing the concrete there is a temperature differential between the concrete and its steel mould and this results in relative movement between the steel moulds and the concrete sleepers. Such movement makes removal of shoulder locating means very difficult, but in this invention the locating means can comprise a withdrawable locating pin which can be withdrawn immediately after pouring, and before the concrete sets, simultaneously wiping any wet slurry from its outer surface and providing clearance for relative movement between the moulds and shoulders which are themselves embedded in the concrete.

BRIEF DESCRIPTION OF THE DRAWINGS

A preferred embodiment of the invention is described hereunder in some detail with reference to, and is illustrated in, the accompanying drawings, in which.

DETAILED DESCRIPTION OF THE PREFERRED EMBODIMENT

Figure 1:
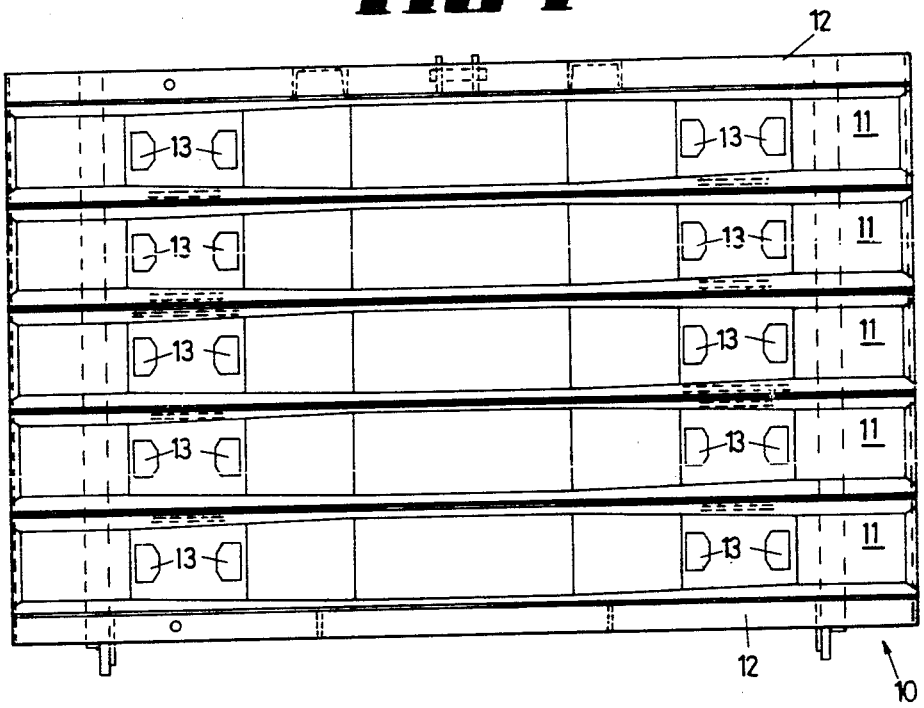
FIG. 1 is a plan view of a bank of moulds in which five sleepers can be moulded side-by-side.

In this embodiment an in-line sleeper installation is provided with a plurality of banks 10 of moulds 11 arranged end to end but spaced from one another by spacers, only one bank being shown. The moulds 11 are arranged in their banks 10 side by side across the bed between sides 12, and each mould is provided with four rectangular apertures 13 which receive portions of cast iron shoulders 14 (shown in chain dot), the shoulders extending through the apertures 13 to have upstanding stems 15 which become embedded in concrete as it is poured into the moulds.

In this embodiment use is made of a type of shoulder 14 which has a depending portion 16 below the mould which comprises a front (datum) wall 17 arranged (in use) to locate against the edge of a rail foot for the maintaining of gauge of a rail line, and this is flanked by two outwardly projecting side wings 18 spaced from one another which, together with the front datum wall, define an underside recess 19. Each of the side wings 18 itself contains a respective inwardly directed shallow plate retaining recess 20 which, in use, will accept portion of a plate type of rail retaining clip (not shown). Such shoulder/retaining clip combinations are well-known.

Figure 2:
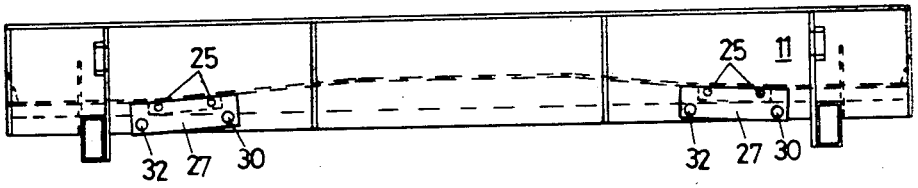
FIG. 2 is a side elevation of FIG. 1.
Figure 3:
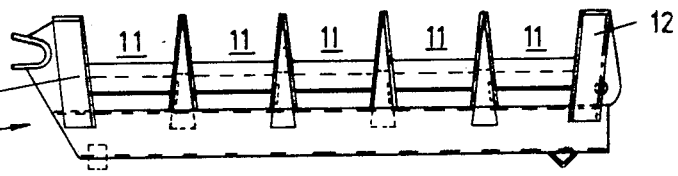
FIG. 3 is an end elevation of FIG. 2.
Figure 4:
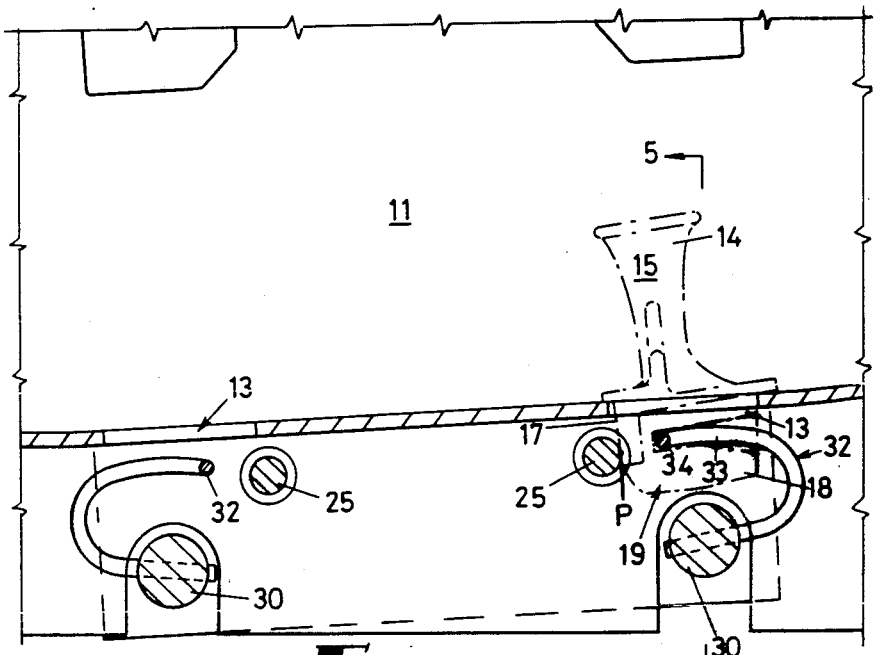
FIG. 4 is a fragmentary sectional side elevation drawn to a larger scale, illustrating two rocker shafts each with retaining members thereon for retaining shoulders against locating means beneath the moulds.
Figure 5:
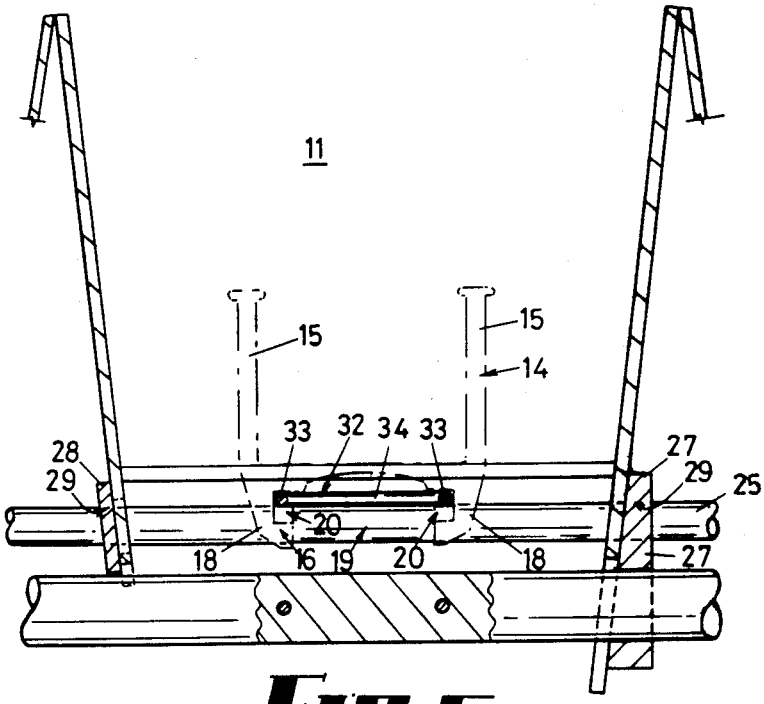
FIG. 5 is a sectional end elevation taken on line 5—5 of FIG. 4.

The aperture walls which define each respective rectangular aperture 13 for receiving the depending portion 16 of its shoulder 14 are only slightly larger than that shoulder portion 16 so that the required tolerance is maintained, and beneath but slightly to one side of each aperture there is located a long circular locating pin 25 with a handle 26 at one end, and this pin is fed into the space beneath the bank of moulds, through an aperture in a first guide block 27 on one side wall and projects out through an aperture in a second guide block 27 on the other side wall (FIGS. 2 and 5), and when so positioned its surface provides a location point P (FIG. 4) against which datum wall 27 of each of a plurality of shoulders 14 bear. There are also provided guide plates 28 on the outer surfaces of the mould sides intermediate the guide blocks 27, also containing pin apertures. All the pin apertures are designated 29.

Figure 6:
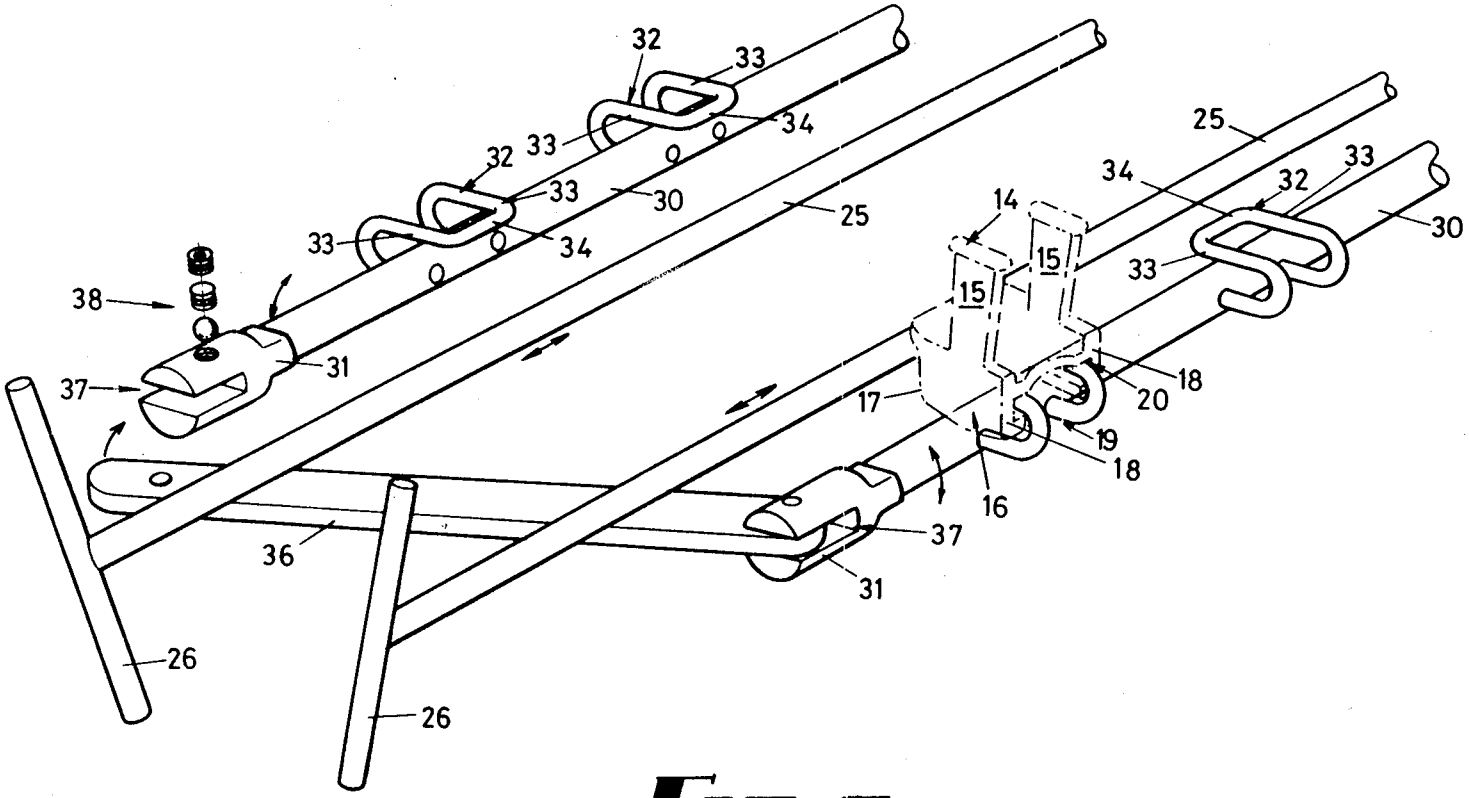
FIG. 6 is a fragmentary perspective view which illustrates the retention and location of a shoulder.

There is also provided a rocker shaft 30 parallel to the withdrawable locating pin 25, the rocker shaft 30 having bosses 31 thereon which constrain it against axial movement and having a plurality of retaining members 32 thereon, in this embodiment each retaining member 32 being of spring steel rod formed to a loop shape, which is a 'U' shape both in plan and in end elevation, the sides 33 of the loop entering the wing side recesses 20 and the bridge 34 bridging across them, one rocker shaft 30 being rotatable at one end by means of a transverse bar 36 pivoted on a projecting end of the rocker shaft 30 (FIG. 6). An adjacent rocker shaft 30 (for an adjacent shoulder), parallel to the first, is similarly rotatable, by a spanner, and in the reverse direction for retention purposes. Spanner engagement flats are provided on the boss 31 of the adjacent rocker shaft 30 for this purpose. Each rocker shaft 30 is journalled in the blocks 27. An end of each rocker shaft contains a slot 37, the pivoted end of bar 36 being in one slot and its swinging end being engageable in the other, but only when both rocker shafts 30 are rotated so that the slots are aligned, and that is when there is sufficient resilient deformation that the retaining members 32 on the rocker shafts 30 to urge all transversely aligned shoulders 14 in one direction so that the front datum walls 17 are placed into firm engagement with a surface on one or other of the relevant locating pins 25. A spring/ball detent 38 releasably retains bar 36 in this position. It should be noted that tolerance can be lost if the deformation is excessive.

After the concrete has been poured but before it has set, the withdrawable locating pins 25 are withdrawn through their apertures in guide blocks 27, and this performs a function of wiping off any wet slurry which may otherwise adhere to the locating pins. After the concrete has set, (or after it has cured), the rocker shafts 30 are rotated so as to release the retaining members 32 from their respective shoulder wing recesses 20. The locating pins are withdrawn before any heat is applied to the moulds, and there is almost no likelihood of "binding" of the shoulders in the moulds which carry them against any locating surface beneath the moulds. The amount of cleaning is reduced to almost nothing because of cleaning by the edges of the apertures of each guide block 27 which supports the withdrawable locating pins, whereby the pin surfaces are scraped clean. Even if slurry build up does take place, it is unlikely to build up on the locating surfaces which are the cleaned surfaces of the locating pins.

A consideration of the above embodiment will indicate that the invention provides means whereby the location of the shoulders can be effected in a fast operation, and there is a considerable saving for maintenance and cleaning with respect to other known mould locating means.

Various modifications in structure and/or function may be made to the disclosed embodiments by one skilled in the art without departing from the scope of the invention as defined by the claims.

I claim:

1. In a bank of sleeper moulds for the moulding of sleepers side by side, wherein said sleeper moulds contain shoulder receiving apertures in which respective shoulders are located during concrete pour, each of said shoulder positioned in said mould such that said shoulder comprises two outwardly projecting side wings each of which contains a respective inwardly directed clip retaining recess, the improvement comprising a rocker shaft located below the moulds and extending across the moulds, bearing surfaces journalling the rocker shaft for rotation about its longitudinal axis, a plurality of retaining members carried on the rocker shaft, locating pins located below the moulds and so positioned as to locate said shoulders with respect to the moulds when the retaining member urge the shoulders into engagement with the locating pins, the shape, size and location of each said retaining member being such that said retaining member enters said clip retaining recesses of said wings of a respective said shoulder and urges that shoulder into firm engagement with a said locating pin when its said rocker shaft is rotated in its bearing surfaces, and retention means releasably retaining that said rocker shaft in its said shoulder engagement position, each of said locating pins extending across the bank of moulds but beneath the moulds and being withdrawable from a side of said bank.

2. Improvements in sleeper moulds according to claim 1 further comprising guide blocks on respective sides of the bank of moulds which retain the pins, said bearing surfaces being surfaces of apertures in the guide blocks.

3. Improvements in sleeper moulds according to claim 2 wherein the bank of moulds comprises two guide blocks on each of two opposite sides, each guide block containing two bearing surfaces which are surfaces of respective apertures extending therethrough, and two further apertures which receive and guide said withdrawable locating pins, there being four said withdrawable locating pins and four said rocker shafts in said bank of moulds.

4. Improvements in sleeper moulds according to claim 1 wherein each said retaining member comprises a loop of spring steel rod extending from said rocker shaft, each said loop being U-shaped in a plane parallel to a longitudinal axis of said rocker shaft and also U-shaped in a plane transverse to said axis, the sides of said loop engaging said clip retaining recesses and the bridge of said loop bridging across them.

5. A bank of sleeper moulds for the moulding of sleepers side by side, each sleeper mould containing four shoulder receiving apertures in a base of said mould for the reception of shoulders, each shoulder comprising a front wall, which in use locates against the edge of a rail foot, flanked by two outwardly projecting side wings spaced from one another, each side wing itself containing a respective inwardly directed clip retaining recess, plate means on the bank of sleeper moulds containing two pairs of bearing apertures on each side, and two pairs of rocker shafts journalled for rotation in said bearing apertures, each said rocker shaft carrying a plurality of retaining loops of spring steel rod each of which is U-shaped in a plane parallel to the longitudinal axis of said rocker shaft and also U-shaped in plane transverse to said axis, the sides of the loop engaging said clip retaining recesses and the bridge of the loop bridging across them and bearing against one surface of the said clip front wall, said plate means also containing two pairs of pin apertures, and two pairs of locating pins extending through those apertures beneath the moulds of said bank, and means for rotating said rocker shafts into positions where said loops bear against said shoulders and firmly engage said shoulders against said locating pins, thereby in turn locating said shoulders with respect to said moulds.

6. A bank of sleeper moulds for the moulding of sleepers side by side according to claim 5 wherein each said rocker shaft comprises a boss at one end, each said boss containing a slot, and further comprising a bar pivoted at one end in the slot of a said boss and positionable in the slot of the boss on the other said shaft of a said pair of rocker shafts as slots are aligned to thereby releasably retain the rocker shafts in their shoulder engaging positions.

7. Improvements in sleeper moulds according to claim 1 wherein each said retaining member is of resiliently deformable material and of such size and shape that it is resiliently deformed upon said urging of the shoulder into firm engagement with a said locating pin.

* * * * *